US005714850A

United States Patent [19]

Kitamura et al.

[11] Patent Number: 5,714,850

[45] Date of Patent: Feb. 3, 1998

[54] INSERTION DEVICE FOR USE WITH SYNCHROTRON RADIATION

[75] Inventors: Hideo Kitamura, Himeji; Takashi Tanaka, Aioi, both of Japan

[73] Assignee: Rikagaku Kenkyusho, Saitama-ken, Japan

[21] Appl. No.: 595,100

[22] Filed: Feb. 1, 1996

[30] Foreign Application Priority Data

Feb. 2, 1995 [JP] Japan ..... 7-015752

[51] Int. Cl.[6] ..... H01J 23/10

[52] U.S. Cl. ..... 315/507; 315/503; 315/5.35

[58] Field of Search ..... 313/503, 507; 385/210, 306; 315/5.35

[56] References Cited

U.S. PATENT DOCUMENTS 5,383,049 1/1995 Carr .

FOREIGN PATENT DOCUMENTS

A-60-68539 4/1985 Japan .

OTHER PUBLICATIONS

T. Tanaka, et al.: "Figure–8 undulator as an insertion device with linear polarization and low on–axis power density", Nuclear Instruments and Methods in Physics Research, Section A, vol.364 (1995) pp. 368–373.

Hideo Onuki: "Elliptically Polarized Synchrotron Radiation Source with Crossed and Retarded Magnetic Fields", Nuclear Instruments and Method in Physics Research, Section A, vol. 246 (1986) pp. 94–98.

H. Kitamura: "Production of circularly polarized synchrotron radiation" Synchrotron Radiation News, vol.5, No.1, 1992, pp. 14–20.

S. Yamamoto et al.: "Generation of Quasi–Circularly Polarized Undulator Radiation with Higher Harmonics", Japanese Journal of Applied Physics, vol.26, No.10, Oct. 1987, pp. L1613–L1615.

*Primary Examiner*—Ashok Patel
*Assistant Examiner*—Vip Patel
*Attorney, Agent, or Firm*—Griffin, Butler, Whisenhunt & Kurtossy

[57] ABSTRACT

The invention provides an insertion device for use with synchrotron radiation, including a horizontal undulator including a plurality of magnets linearly arranged along an axis of electron beams so that alternately positioned magnets have common polarity, and a vertical undulator including a plurality of magnets linearly arranged along an axis of electron beams so that alternately positioned magnets have common polarity. The horizontal and vertical undulators are perpendicularly centered about axes thereof, and arranged to be axially offset so that magnetic fields produced by the horizontal and vertical undulators are perpendicular to each other and a magnetic field produced by one of the horizontal and vertical undulators is inverted for each period of a magnetic field produced by the other. The insertion device is positioned in a straight section between bending magnets of a circular accelerator. In operation, the insertion device causes electrons beams to rotate alternately in opposite directions in a FIG. 8 fashion about an axis of the electron beams.

14 Claims, 9 Drawing Sheets

INSERTION DEVICE FOR USE WITH SYNCHROTRON RADIATION

BACKGROUND OF THE INVENTION

1. Field of the Invention

The invention relates to an insertion device for use with synchrotron radiation and more particularly to such an insertion device capable of causing highly energized electrons to move in a periodic field to thereby generate highly-oriented polarized light.

2. Description of the Related Art

Synchrotron radiation is a light discovered in the 1940s based on the fact that electrons moving at approximate the speed of light in a circular accelerator tangentially emit intense electromagnetic waves. Such light can be produced by means of a large-sized radiated light emitting equipment as schematically illustrated in FIG. 1.

The illustrated radiated light emitting equipment comprises an electron gun 1, a linear accelerator 2, a synchrotron 3, an accumulation ring 4, a plurality of beam lines 5 and synchrotron radiation experimental devices 6 associated with the beam lines 5. Electrons 7 emitted from the electron gun 1 are accelerated through the linear accelerator 2, for instance, to 1 GeV and fed into the synchrotron 3. The electrons 7 are further accelerated in the synchrotron 3 by radio-frequency waves, for instance, to 8 GeV, and fed to the accumulation ring 4 acting as a circular accelerator. The electrons are made to rotate at high speed in the accumulation ring 4 by means of a radio-frequency accelerator with the electrons being maintained at high energy (for instance, 8 GeV). When the orbit of the electrons is changed, synchrotron radiation 8 is emitted. This synchrotron radiation 8 is introduced to the synchrotron radiation experimental devices 6 through the beam lines 5. The accumulation ring or circular accelerator 4 is a large-sized equipment having a perimeter of about 1500 m, and each of the beam lines 5 may have a length ranging from 80 m to 1000 m, for instance, depending on the use to which the synchrotron radiation 8 is put.

The synchrotron radiation as mentioned above is a flux of intense light having wide wavelength ranges from infrared rays having longer wavelength than that of visible light to ultraviolet rays, soft X-rays and hard X-rays, each having shorter wavelength than that of visible lights, and is characterized by intensive orientation. The synchrotron radiation has been called "a dream light" among scientists, and can be utilized in various fields as follows: (a) research into the structure and characteristics of materials such as arrangement of atoms in a crystal and structure of superconducting materials, (b) research into the structure and functions of dynamic processes such as the growing of a crystal and chemical reaction processes (c) research in the life sciences and biotechnology, (d) development of new materials including detection of lattice defects and impurities, and (e) medical applications such as the diagnosis of cancer.

The above mentioned synchrotron radiation is quite intense light source in a region ranging from vacuum ultraviolet (VUV) having a wavelength equal to or less than 2000 angstroms to X-rays having a wavelength of about one angstrom, which region is quite difficult to obtain by other light sources. The synchrotron radiation has the following advantages.

A. If electron energy is sufficiently high, the synchrotron radiation exhibits a continuous strength profile in a wide wavelength range from X-ray to far infrared radiation.

Therefore synchrotron radiation having desired wavelength can be gained by use of monochromator.

B. Due to relativistic effects, the synchrotron radiation has acute orientation in a direction in which electron beams run, and hence can have practically high light intensity.

C. The synchrotron radiation has remarkable linear polarization, and its oscillation plane is in parallel with an orbital plane of the electron beams. However, elliptic polarization is caused if light is received at an angle with respect to an orbital plane.

As the synchrotron radiation has been used and researched, it was found that the synchrotron radiation has the following shortcomings.

A. Since the light intensity of the synchrotron radiation ranges in quite broad wavelength range, it is unavoidable for monochromatized light to contain significant amounts of higher harmonics and stray light, and further an optical device is worn out by light in the unused wavelength range.

B. The orientation of the synchrotron radiation is better than that of an X-ray tube having three-dimensional orientation, but not as sharp as that of laser having one-dimensional orientation.

Thus, as illustrated in FIG. 2 which is a view showing the equipment illustrated in FIG. 1 in more detail, an insertion device called an undulator 1 has been researched and developed. This insertion device is disposed in a straight section between bending magnets of the accumulation ring or circular accelerator to emit monochromatic light having improved orientation. Such an undulator has been reported in many articles, for instance, "View about Light Source for Synchrotron Radiation Users", Japanese Society for Synchrotron Radiation Research 2nd Meetings Pre-distributed Booklet, 1989, and "Technology of High Brilliant Synchrotron Radiation", Physical Society of Japan Report, Vol. 44, No. 8, 1989.

An undulator includes a linear undulator as illustrated in FIG. 3A and a helical undulator as illustrated in FIG. 4A. The linear undulator comprises a plurality of magnets linearly arranged so that alternatively disposed magnets have common polarity, while the helical undulator comprises horizontal and vertical undulators. Magnetic fields produced by the horizontal and vertical undulators are arranged to be perpendicular to each other, and phases thereof are arranged to be offset to each other. One of examples of the helical undulator is found in Hideo Kitamura (the applicant) "Production of circularly polarized synchrotron radiation", Synchrotron Radiation News, Vol. 5, No. 1, 1992. The linear undulator provides linearly polarized radiation since electron beams 9 orbits in a plane so that the electron beams move in a zigzag direction as illustrated in FIG. 3B, while the helical undulator provides circularly polarized radiation since the electron beams 9 spirally moves as illustrated in FIG. 4B.

The linearly polarized intensive radiation caused by an undulator in vacuum ultraviolet and X-rays regions is important in particular in fields such as high resolution spectroscopic experiment utilizing monochromaticity and orientation, X-ray diffraction in minute regions, an X-ray microscope and an X-ray holography.

However, in the linear undulator which generates linearly polarized radiation, there is produced linearly polarized radiation having a desired frequency (for instance, u), and in addition, k-th (k: odd number) higher harmonics (for instance, 3 u and 5 u) are also produced in Z-axis direction. Hence, an optical device is damaged due to heat load (hn u. h: Planck's constant) of light in the unused wavelength range. In certain cases, an optical device utilized with the synchrotron radiation is melted out and hence is no longer usable.

SUMMARY OF THE INVENTION

In view of the problems of prior art as mentioned above, it is an object of the present invention to provide an insertion device for use with synchrotron radiation, which device is capable of emitting linearly polarized intensive light and emitting less higher harmonics to thereby reduce damage to an optical device caused by heat load of lights in the unused wavelength range.

The invention provides an insertion device for use with synchrotron radiation, the insertion device being positioned in a straight section between bending magnets of a circular accelerator, the insertion device causing electrons beams to rotate alternately in opposite directions in a FIG. 8 fashion about an axis of the electron beams.

In one embodiment, the insertion device comprises a horizontal undulator including a plurality of magnets linearly arranged along an axis of electron beams so that alternately positioned magnets have common polarity, and a vertical modulator including a plurality of magnets linearly arranged along an axis of electron beams so that alternately positioned magnets have common polarity. The horizontal and vertical undulators are perpendicularly centered about an axes thereof and are arranged to be axially offset so that magnetic fields produced by the horizontal and vertical undulators are perpendicular to each other and a magnetic field produced by one of the horizontal and vertical undulators is inverted for each period of a magnetic field produced by the other.

In another preferred embodiment, one of the horizontal and vertical undulators has a period length twice longer than that of the other.

The invention still further provides an insertion device for use with synchrotron radiation, including a horizontal undulator including a pair of magnet arrays each including a plurality of linearly arranged magnets along an axis of electron beams so that alternately positioned magnets have common polarity, the magnet arrays being positioned facing each other, and a vertical undulator including a pair of magnet arrays each including a plurality of linearly arranged magnets along an axis of electron beams so that alternately positioned magnets have common polarity, the magnet arrays being positioned facing each other. The horizontal and vertical undulators are perpendicularly centered about an axes thereof. Each magnet of the magnet arrays of one of the horizontal and vertical undulators axially has a width twice greater than that of each magnet of the magnet arrays of the other.

The insertion device for use with synchrotron radiation made in accordance with the invention causes electron beams to rotate in opposite directions in turn in a FIG. 8 fashion about the axes of the electron beams to thereby significantly suppress generation of higher harmonics, similarly to a helical undulator. In addition, the electron beams are made to move in a FIG. 8 shaped path between two points spaced away from each other, and hence, the electron beams move in a zigzag direction in both a plane containing therein the above mentioned two points and a Z-axis and a plane perpendicular to the plane, resulting in that it is possible to produce linearly polarized radiation similarly to a linear undulator.

Namely, the above mentioned rotational movement suppresses generation of higher harmonics, and in addition, the rotational movement in opposite directions cancels components of circularly polarized radiation and produces linearly polarized radiation. This is based on the fact that combination of circularly polarized radiation in counterclockwise and clockwise directions makes linearly polarized radiation.

Thus, the insertion device made in accordance with the invention is capable of emitting linearly polarized intensive light and emitting less higher harmonics to thereby significantly reduce damages to an optical device caused by heat load of light in the unused wavelength range.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

A preferred embodiment in accordance with the present invention will be explained hereinbelow with reference to drawings.

Figure 1:
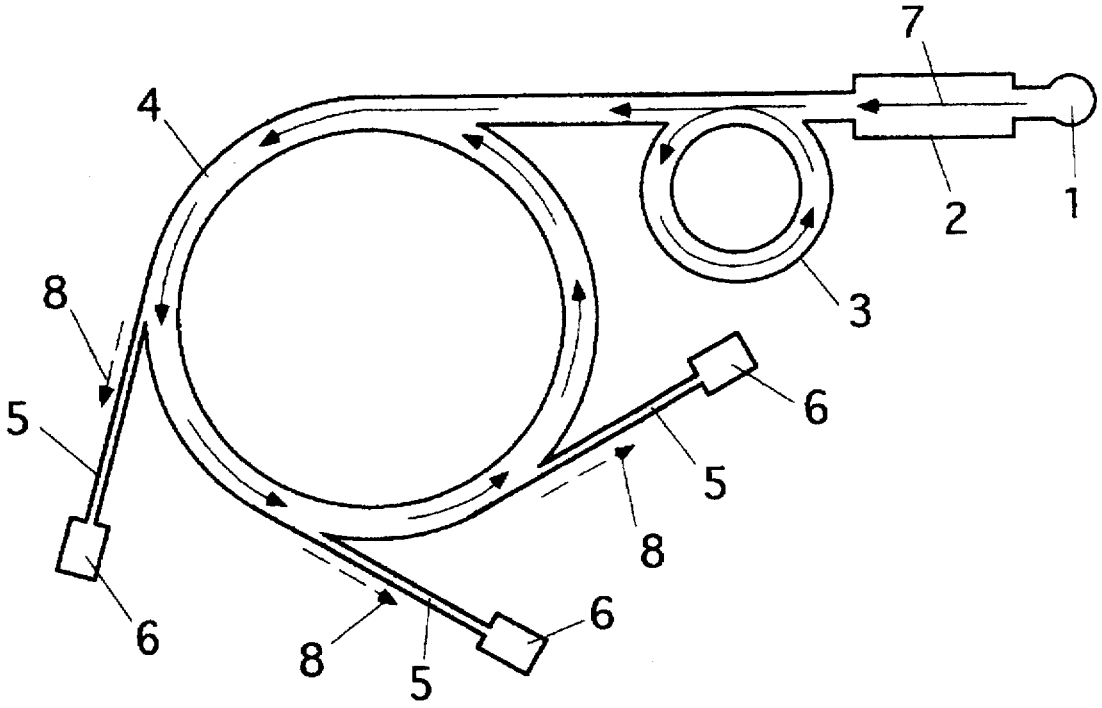
FIG. 1 PRIOR ART
FIG. 1 is a schematic view illustrating a large-sized light radiation emitting equipment.
Figure 2:
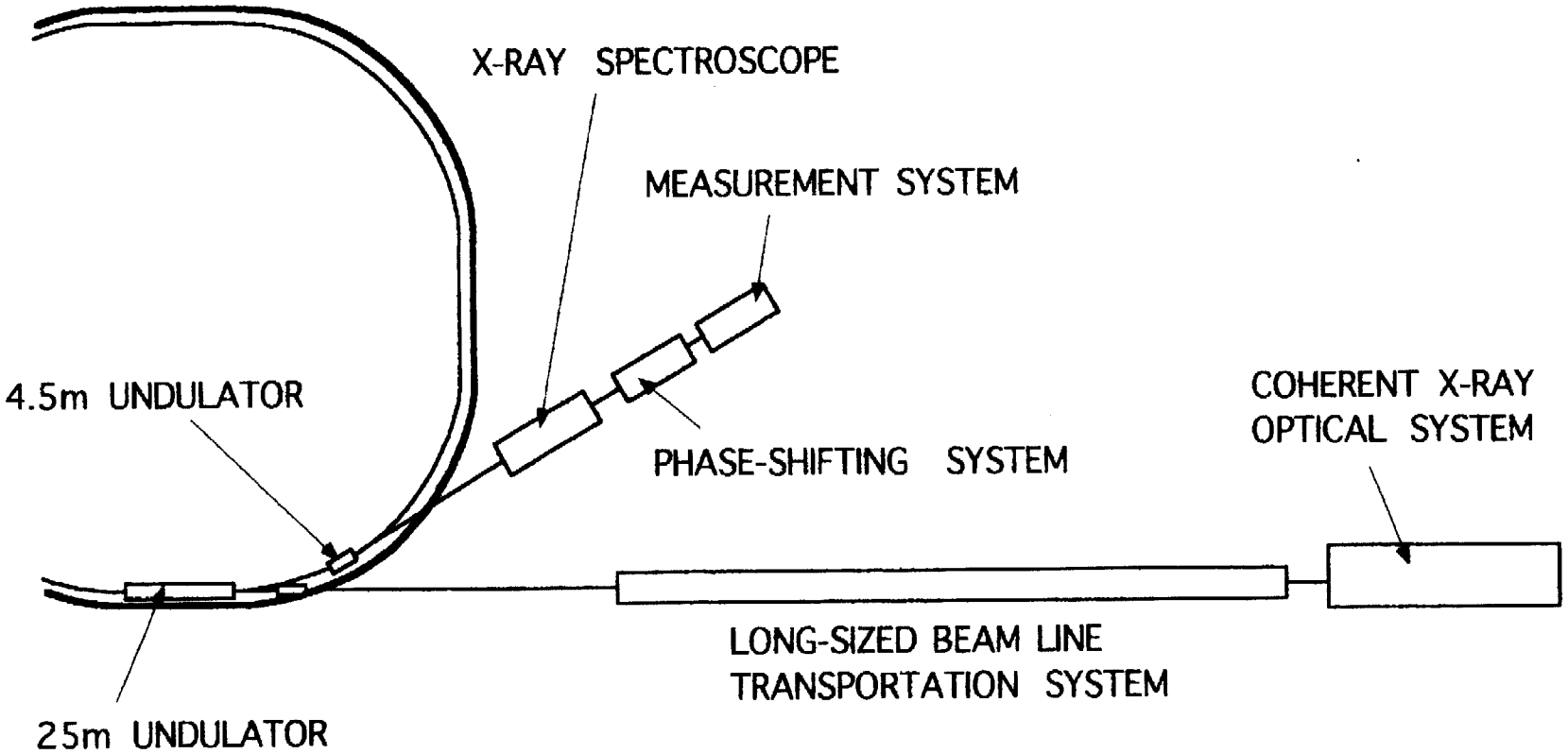
Fig.2 PRIOR ART
FIG. 2 is an enlarged view of a part of the equipment illustrated in FIG. 1.
Figure 3A:
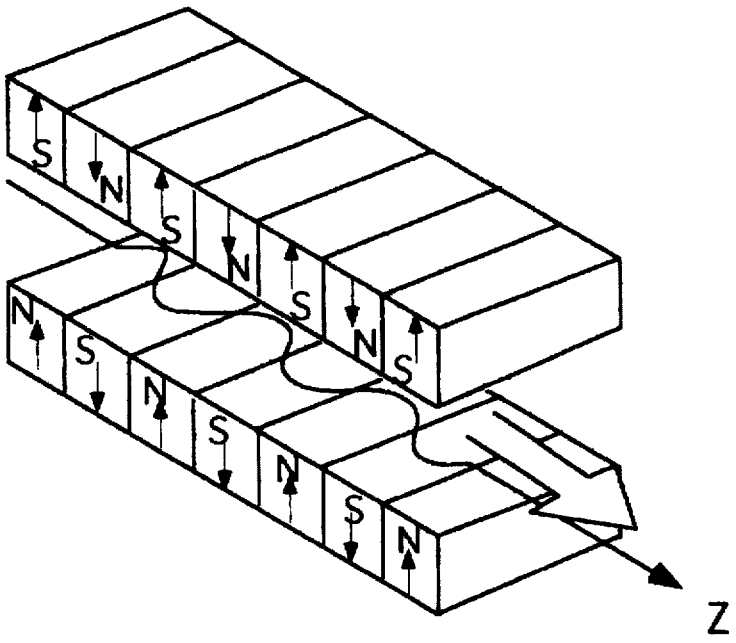
FIG. 3A PRIOR ART
FIG. 3A is a schematic view illustrating a conventional linear undulator.
Figure 3B:
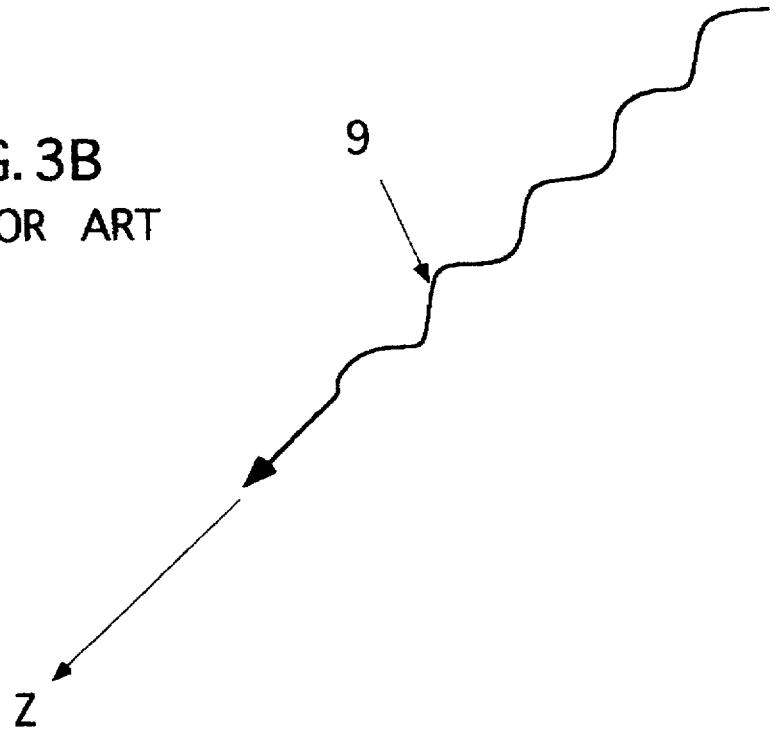
FIG. 3B PRIOR ART
FIG. 3B is a schematic view illustrating orbit of an electron beam emitted from the conventional linear undulator illustrated in FIG. 3A.
Figure 4A:
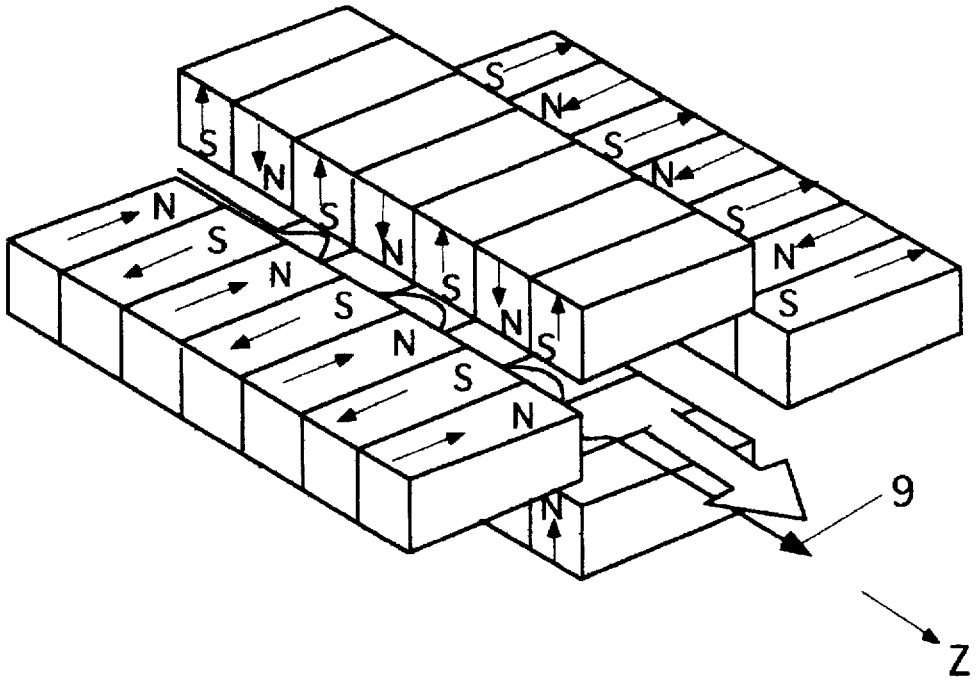
FIG. 4A PRIOR ART
FIG. 4A is a schematic view illustrating a conventional helical undulator.
Figure 4B:
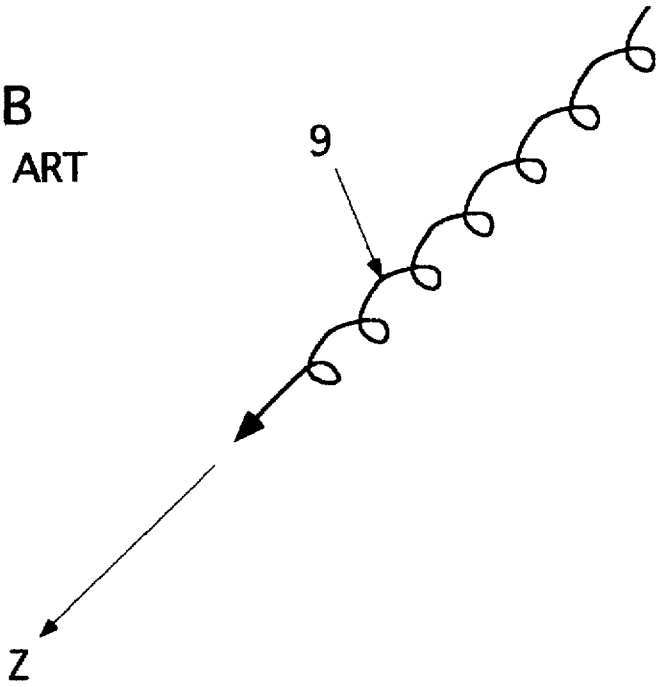
FIG. 4B PRIOR ART
FIG. 4B is a schematic view illustrating orbit of an electron beam emitted from the conventional helical undulator illustrated in FIG. 4B.
Figure 5A:
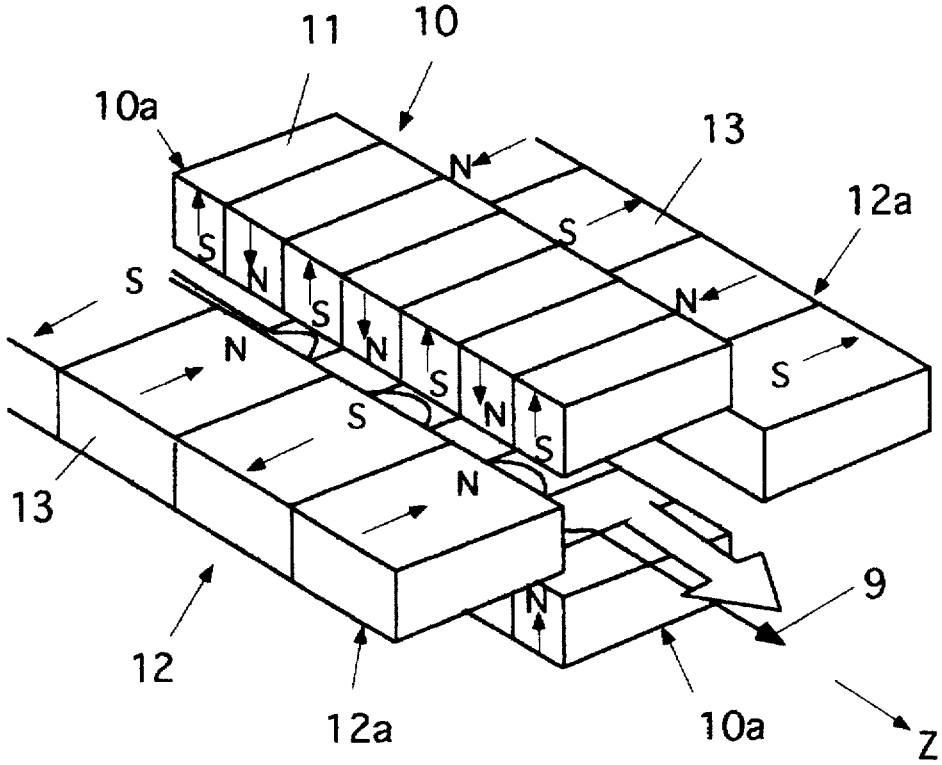
FIG. 5A is a perspective view illustrating an insertion device for use with synchrotron radiation made in accordance with the first embodiment of the present invention.
Figure 5B:
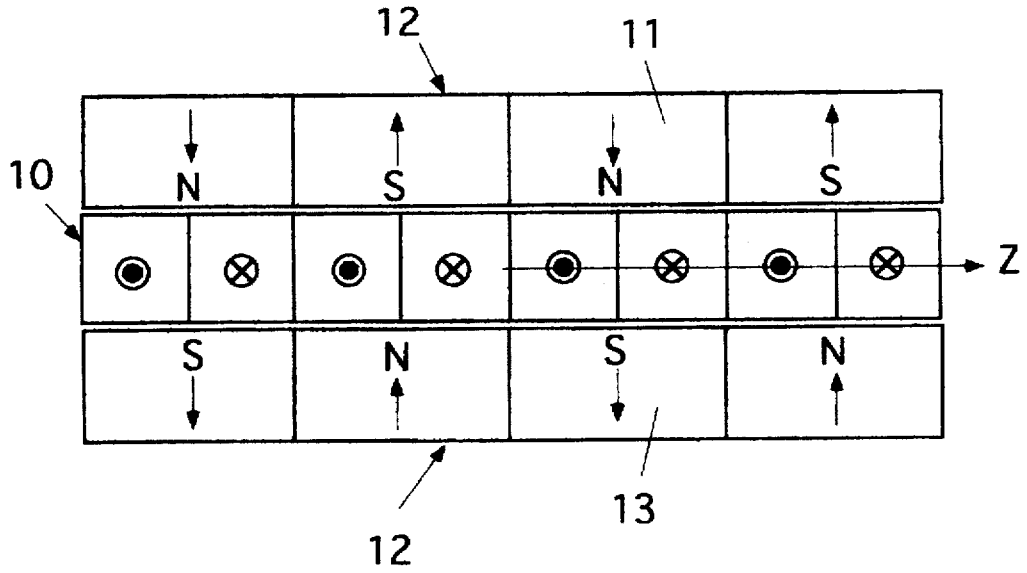
FIG. 5B is a plan view of the insertion device illustrated in FIG. 5A.

With reference to FIGS. 5A and 5B, an insertion device in accordance with the embodiment comprises a horizontal undulator 10 and a vertical undulator 12 each of which are disposed in a straight section between bending magnets of a circular accelerator. Each of the horizontal and vertical undulators 10 and 12 includes a pair of magnet arrays 10*a* and 12*a*, respectively. Each of the magnet arrays 10*a* and 12*a* comprises a plurality of magnets 11 and 13 linearly arranged along an axis Z of an electron beam 9. The magnets 11 and 13 are arranged so that alternatively disposed magnets have common polarity N or S. Namely, N polarity magnets are sandwiched between S polarity magnets and S polarity magnets are sandwiched between N polarity magnets.

The horizontal and vertical undulators 10 and 12 are centered about the axis Z, positioned perpendicularly to each other, and arranged to be axially offset so that magnetic fields produced by the horizontal and vertical undulators 10 and 12 are perpendicular to each other and a magnetic field produced by one of the horizontal and vertical undulators 10 and 12 is inverted for each period of a magnetic field produced by the other. Herein, magnetization orientation of the magnets 11 and 13 is indicated with a small arrow.

In the embodiment illustrated in FIGS. 5A and 5B, the magnets 13 constituting the vertical undulator 12 has an axial length twice longer than an axial length of the magnets 11 of the horizontal undulator 10, and thereby the vertical undulator 12 has a period length twice longer than that of the horizontal undulator 10. This arrangement makes a magnetic field produced by the vertical undulator 12 inverted for each period of a magnetic field produced by the horizontal undulator 10.

Figure 6A:
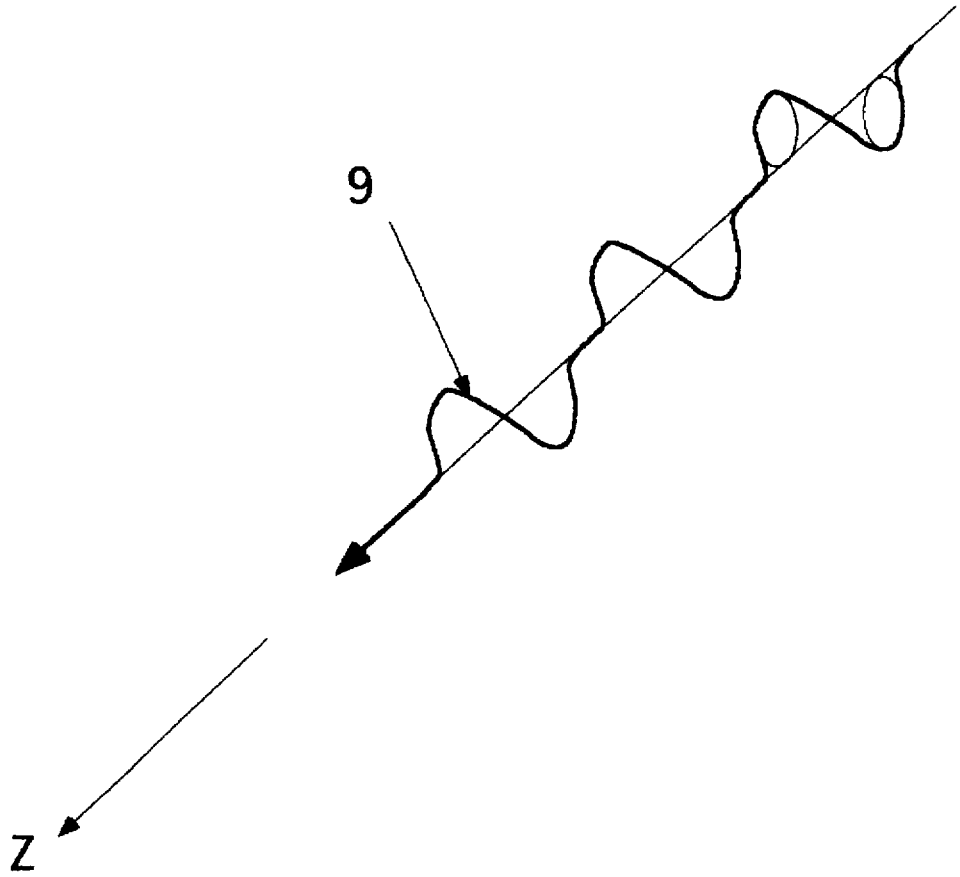
FIG. 6A is a perspective view illustrating orbit of an electron beam emitted from the insertion device illustrated in FIG. 5A.
Figure 6B:
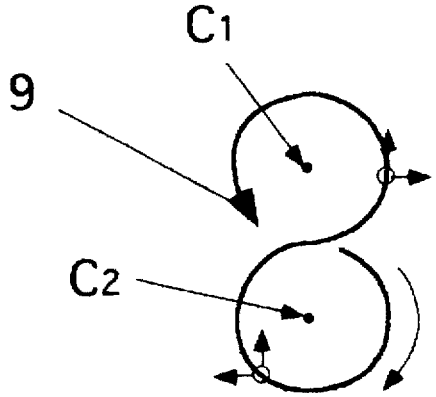
FIG. 6B is a Z-axis direction view of the orbit illustrated in FIG. 6A.

FIGS. 6A is a perspective view showing orbit of the electron beam 9 moving in the insertion device illustrated in FIG. 5A, and FIG. 6B shows the orbit as viewed in the Z-axis direction. As illustrated in FIG. 6B, the electron beam 9 axially moves at approximate velocity of light, and is influenced by the magnetic field produced by the horizontal and vertical undulators 10 and 12 to thereby rotate in counterclockwise and clockwise directions alternatively along a FIG. 8 shaped path about two points C1 and C2 spaced away from each other as viewed in a direction of an axis of the electron beam 9. It should be noted that FIGS. 6A and 6B show enlarged orbit for clarity, and that in practical orbit, an interval between the points C1 and C2 is a few microns (μm) when E=8 GeV.

Figure 7A:
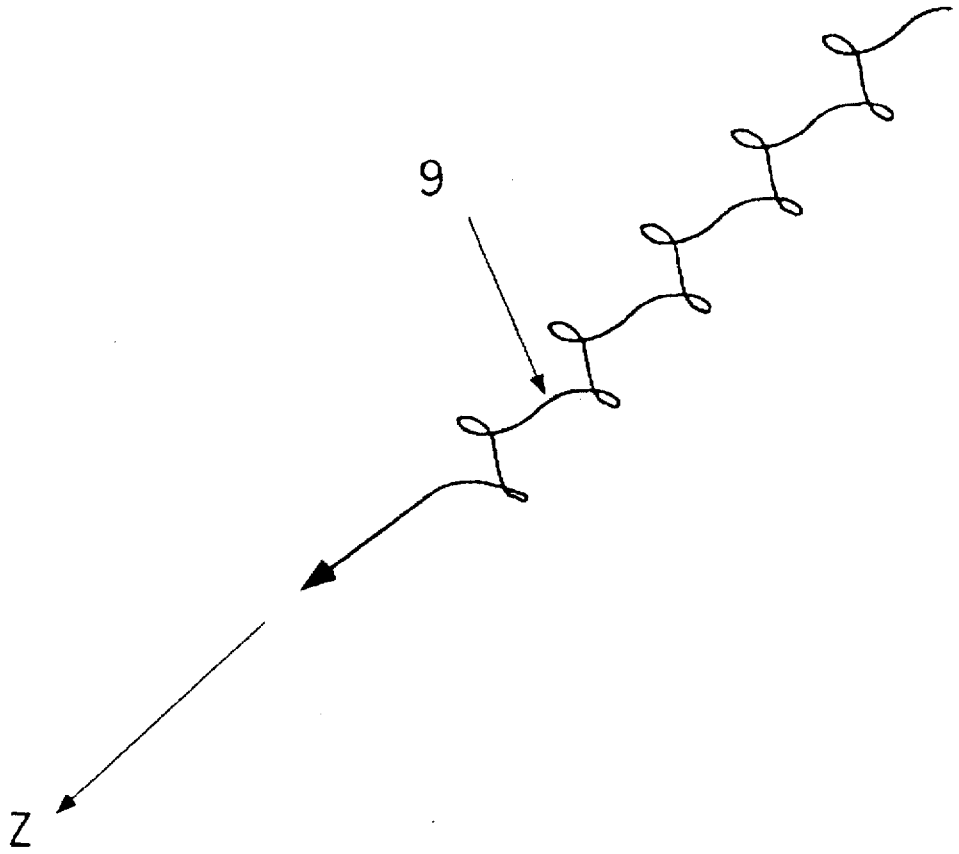
FIG. 7A is a perspective view illustrating orbit of an electron beam emitted from an insertion device made in accordance with another embodiment of the invention.
Figure 7B:
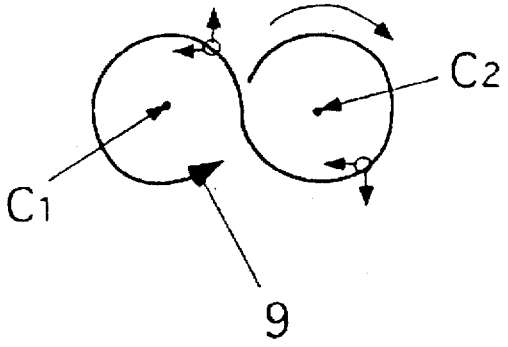
FIG. 7B is a Z-axis direction view of the orbit illustrated in FIG. 7A.

As illustrated in FIGS. 7A and 7B, it is also possible to obtain the same orbit as that illustrated in FIGS. 6A and 6B by arranging a period length of the horizontal undulator 10 to be twice longer than that of the vertical undulator 12. The orbit illustrated in FIGS. 7A and 7B is identical with the orbit illustrated in FIGS. 6A and 6B except that the points C1 and C2 are horizontally disposed as illustrated in FIGS. 7B.

Figure 8:
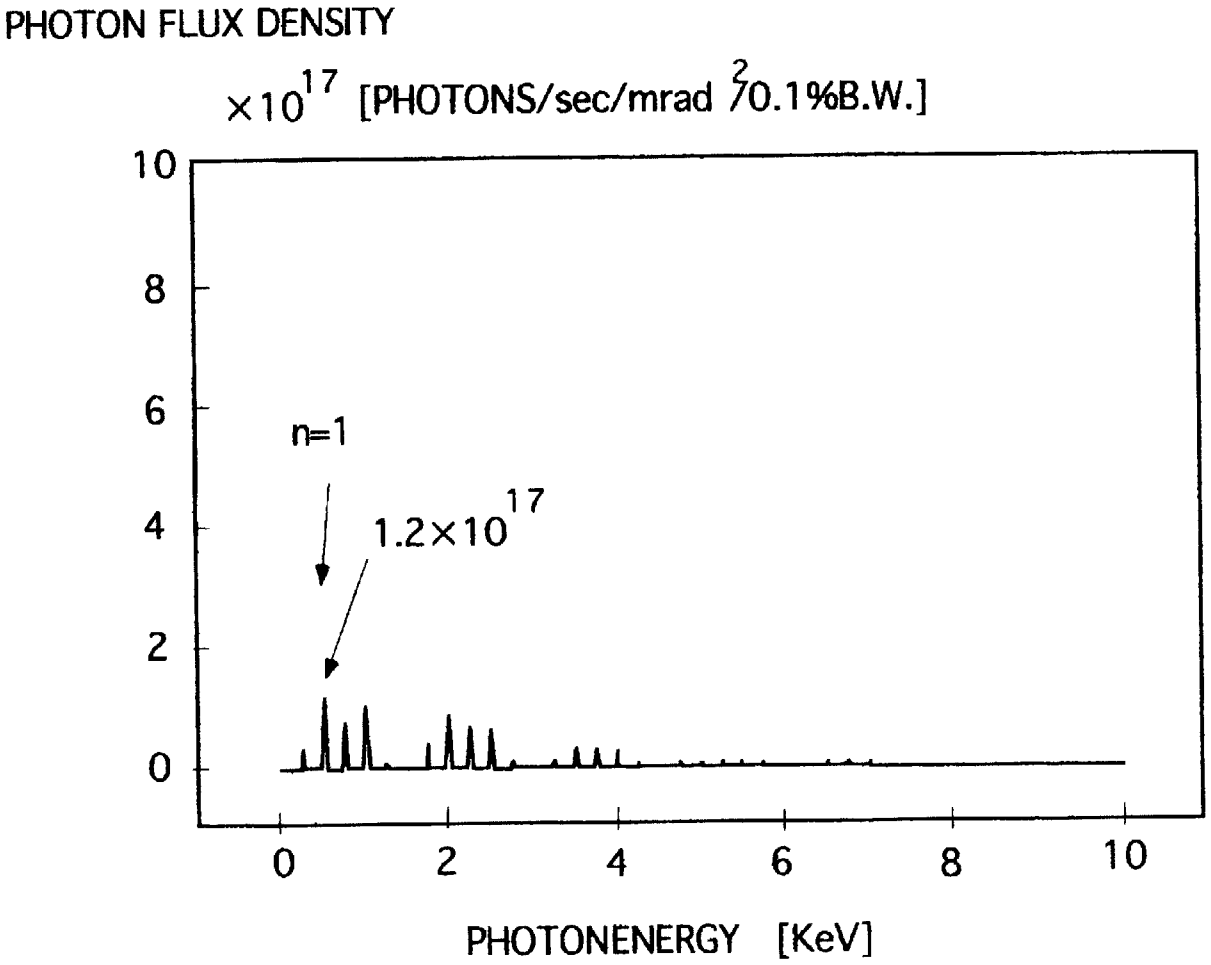
FIG. 8 shows art, example of photon flux density of linearly polarized radiation emitted from an insertion device made in accordance with the invention.

The insertion device made in accordance with the embodiment causes electron beams to rotate in opposite direction in turn in a FIG. 8 fashion about axes of the electron beams to thereby significantly suppress generation of higher harmonics, similarly to a helical undulator. In addition, the electron beams are made to move in a FIG. 8 shaped path between the two points C1 and C2 spaced away from each other, and hence, the electron beams move in a zigzag direction in both a plane containing therein the two points C1 and C2 and a Z-axis and a plane perpendicular to the first mentioned plane, resulting in the production of linearly polarized radiation similar to that of a linear undulator.

In other words, the above mentioned rotational movement suppresses generation of higher harmonics, and in addition, the rotational movement in opposite directions cancels components of circularly polarized radiation and produces linearly polarized radiation. This is based on the physical law that combination of circularly polarized radiation in counterclockwise and clockwise directions makes linearly polarized radiation.

Figure 9:
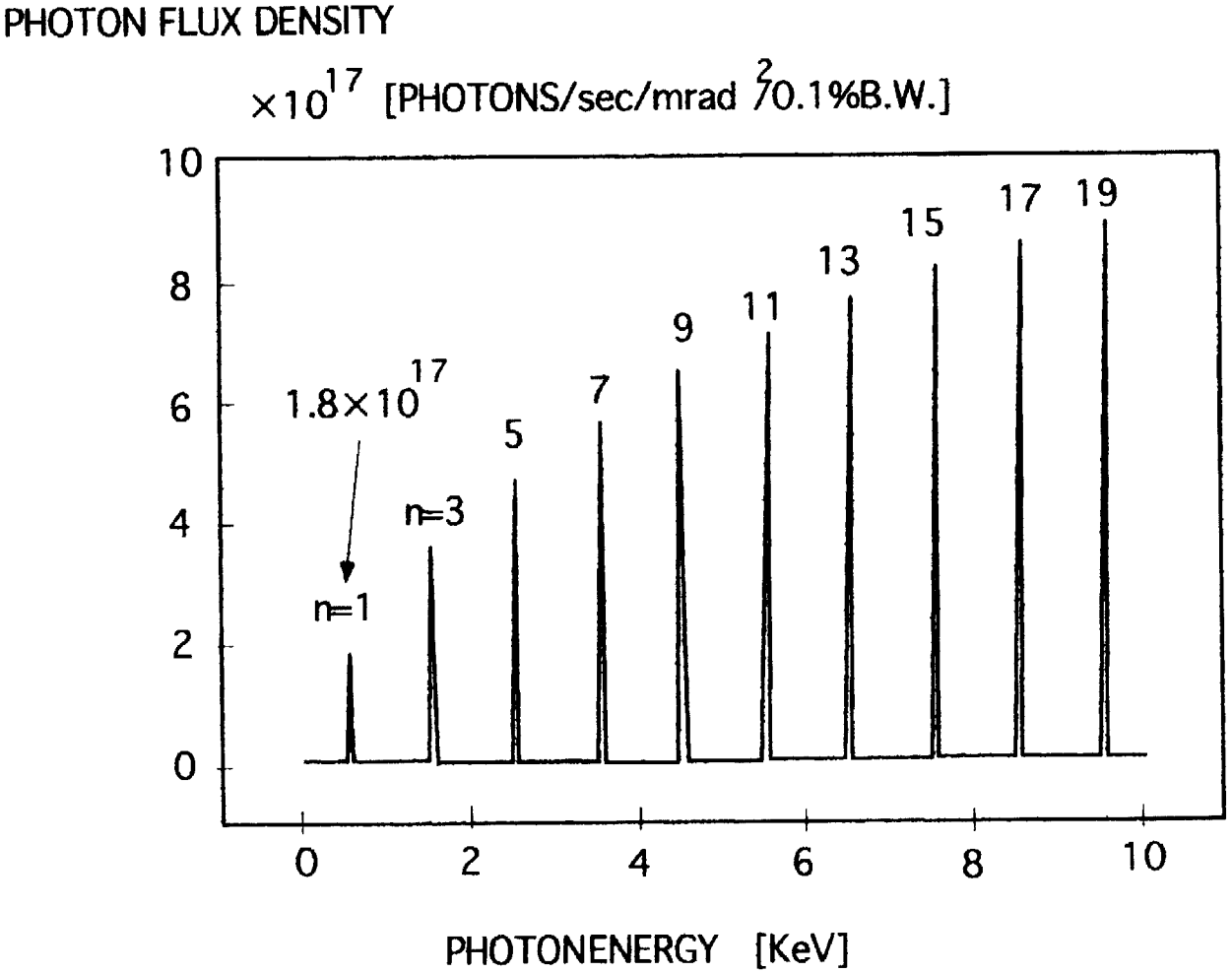
FIG. 9 shows an example of photo flux density of radiation emitted from a conventional linear undulator.

FIG. 8 shows an example of photon flux density of linearly polarized radiation emitted from an insertion device made in accordance with the invention, whereas FIG. 9 shows an example of photo flux density of radiation emitted from a conventional linear undulator. For comparison, the photon flux densities shown in FIGS. 8 and 9 are calculated under the same conditions where accelerator beam energy is 8 GeV and an undulator period length is 10 cm.

As is dearly shown in FIG. 9, a conventional undulator produces n-th harmonics (n: odd number ranging from 3 to 19) having quite high photo flux density in a Z-axis direction as well as radiation having a desired frequency (primary frequency, n=1). Thus, heat load of radiation in unused wavelength range wears the optical device out, and may melt the device in certain cases with the result that the device is no longer usable.

The insertion device made in accordance with the invention also produces higher harmonics other than radiation having a desired frequency (n=1). However, as is clear in FIG. 8, the photo flux densities of those higher harmonics are much smaller than those of FIG. 9, indicating that it is possible to remarkably reduce damage to an optical device caused by heat load of radiation in the unused wavelength range.

Table 1 shows comparison in photon flux density and power density between a conventional undulator and an insertion device made in accordance with the invention (FIG. 8 type) under the same conditions.

TABLE 1

Comparison between a conventional undulator and a figure 8 type undulator

| Undulator | Photon Flux Density [Photons/sec/mrad$^2$/0.1% B.W.] | Power Density [kW/mrad$^2$] |
|---|---|---|
| Conventional | $1.8 \times 10^{17}$ | 100 |
| Figure 8 type | $1.2 \times 10^{17}$ | 1.4 |

It is found from Table 1 that the photon flux density of a desired frequency (n=1) is almost the same between conventional and FIG. 8 type undulators, but the power density of the insertion device made in accordance with the invention is just 1.4% of the conventional undulator, showing that the insertion device made in accordance with the invention makes it possible to remarkably reduce heat load received by an optical device relative to a conventional undulator.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An insertion device, for treating a synchrotron radiation beam, comprising:

a horizontal undulator disposed around said radiation beam; and a vertical undulator disposed around said radiation beam;

wherein said horizontal and vertical undulators are arranged so that electrons in said radiation beam are caused to travel in a helical path shaped substantially like a figure-eight in cross section.

2. An insertion device, for treating a synchrotron radiation beam, comprising:

a horizontal undulator disposed around said radiation beam including a plurality of magnets, wherein alternatively disposed magnets have a common polarity; and a vertical undulator disposed around said radiation beam and including a plurality of magnets, wherein alternatively disposed magnets have a common polarity;

wherein said horizontal and vertical undulators are axially offset, so that electrons in said radiation beam are caused to travel in a helical path shaped substantially like a figure-eight in cross section.

3. An insertion device according to claim 2, wherein said horizontal and vertical undulators are perpendicular.

4. An insertion device according to claim 3, wherein one of said vertical and horizontal undulators has a period twice as long as the other.

5. An insertion device for treating a synchrotron radiation beam, comprising:

a horizontal undulator including a pair of facing magnet arrays disposed around said radiation beam, each array including a plurality of magnets arranged linearly along an axis of said radiation beam, wherein alternate magnets in each array have a common polarity; and a vertical undulator including a pair of facing magnet arrays disposed around said radiation beam, each array including a plurality of magnets arranged linearly along an axis of said radiation beam, wherein alternate magnets in each array have a common polarity;

wherein one of said horizontal and vertical undulators has magnets having a width twice a width of the magnets of the other of said horizontal and vertical undulators.

6. An insertion device according to claim 5, wherein electrons in said radiation beam are caused to travel in a helical path shaped substantially like a figure-eight in cross section.

7. An insertion device according to claim 6, wherein said horizontal and vertical undulators are perpendicular.

8. A method of treating a synchrotron radiation beam comprising the steps of passing the beam through an insertion device comprising horizontal and vertical undulators, and deflecting the beam so that electrons in the beam are caused to travel in a helical path shaped substantially like a figure-eight in cross section.

9. A method of treating a synchrotron radiation beam comprising the steps of:

(1) passing said beam through an insertion device comprising:

a horizontal undulator disposed around said radiation beam including a plurality of magnets, wherein alternatively disposed magnets have a common polarity;

a vertical undulator disposed around said radiation beam and including a plurality of magnets, wherein alternatively disposed magnets have a common polarity; and (2) offsetting said horizontal and vertical undulators, so that electrons in said radiation beam are caused to travel in a helical path shaped substantially like a figure-eight in cross section.

10. A method according to claim 9, wherein said horizontal and vertical undulators are perpendicular.

11. A method according to claim 10, wherein one of said vertical and horizontal undulators has a period twice as long as the other.

12. A method of treating a synchrotron radiation beam comprising the step of:

passing the radiation beam through an insertion device, comprising:

a horizontal undulator including a pair of facing magnet arrays disposed around said radiation beam, each array including a plurality of magnets arranged linearly along an axis of said radiation beam, wherein alternate magnets in each array have a common polarity; and a vertical undulator including a pair of facing magnet arrays disposed around said radiation beam, each array including a plurality of magnets arranged linearly along an axis of said radiation beam, wherein alternate magnets in each array have a common polarity;

wherein one of said horizontal and vertical undulators has magnets having a width twice a width of the magnets of the other of said horizontal and vertical undulators.

13. A method according to claim 12, further comprising the step of causing electrons in said radiation beam to travel in a helical path shaped substantially like a figure-eight in cross section.

14. A method according to claim 13, wherein said horizontal and vertical undulators are perpendicular.

* * * * *